US012467202B2

(12) United States Patent
Heiskanen et al.

(10) Patent No.: US 12,467,202 B2
(45) Date of Patent: Nov. 11, 2025

(54) METHOD FOR MANUFACTURING FILMS COMPRISING HIGHLY REFINED CELLULOSE FIBERS

(71) Applicant: Stora Enso OYJ, Helsinki (FI)

(72) Inventors: Isto Heiskanen, Imatra (FI); Kaj Backfolk, Lappeenranta (FI)

(73) Assignee: Stora Enso OYJ, Helsinki (FI)

( * ) Notice: Subject to any disclaimer, the term of this patent is extended or adjusted under 35 U.S.C. 154(b) by 265 days.

(21) Appl. No.: 17/998,235

(22) PCT Filed: May 10, 2021

(86) PCT No.: PCT/IB2021/053949
§ 371 (c)(1),
(2) Date: Nov. 8, 2022

(87) PCT Pub. No.: WO2021/229406
PCT Pub. Date: Nov. 18, 2021

(65) Prior Publication Data

US 2023/0349099 A1 Nov. 2, 2023

(30) Foreign Application Priority Data

May 11, 2020 (SE) ..... 2050548-3

(51) Int. Cl.
*D21F 1/80* (2006.01)
*D21F 11/02* (2006.01)
*D21H 11/18* (2006.01)

(52) U.S. Cl.
CPC ..... *D21F 1/80* (2013.01); *D21F 11/02* (2013.01); *D21H 11/18* (2013.01)

(58) Field of Classification Search
CPC . D21F 1/80; D21F 11/02; D21F 11/00; D21F 1/00; D21F 3/0272; D21H 11/18; C08J 2301/02; C08J 5/18; B82Y 30/00; B32B 2307/7244
See application file for complete search history.

(56) References Cited

U.S. PATENT DOCUMENTS

2008/0210397 A1 9/2008 Scherb et al.
2009/0020248 A1 1/2009 Sumnicht et al.
2012/0298319 A1 11/2012 Fujiwara et al.
2015/0068973 A1 3/2015 Bessonoff et al.
2019/0234020 A1* 8/2019 Backfolk ..... D21H 27/38

FOREIGN PATENT DOCUMENTS

DE 102006017974 A1 10/2007

OTHER PUBLICATIONS

Aslund P., Vomhoff H. "Evaluation of membrane-assisted dewatering on a pilot paper machine", In: Nordic Pulp and Paper Research Journal, 2008, vol. 23, No. 2, op. 152-155, ISSN 0283-2631 (Year: 2008).*
On suction box dewatering mechanisms Peter Aslund STFI-Packforsk AB Box 5604, SE-11486 Stockholm, Sweden (Year: 2008).*
International Search Report from corresponding PCT application No. PCT/IB2021/053949, mailed on Jun. 23, 2021.
Fengel, D., Ultrastructural behaviour of cell wall polysaccharides, TAPPI, vol. 53, No. 3, pp. 497-503, 1970. (Abstract only).
Chinga-Carrasco, Gary, Cellulose fibres, nanofibrils and microfibrils: The morphological sequence of MFC components from a plant physiology and fibre technology point of view, Chinga-Carrasco Nanoscale Research Letters, 2011, 6:417.
Åslund, P., Vomhoff, H., Evaluation of membrane-assisted dewatering on a pilot paper machine, Nordic Pulp and Paper Research Journal, 2008, vol. 23, No. 2, pp. 152-155.
Åslund, P., 1.4 Membrane-assisted dewatering in: On suction box dewatering mechanisms: Royal Institute of Technology, Department of Fibre and Polymer Technology, School of Chemical Science and Engineering, 2008, TRITA-CHE Report 2008:38, s. 9-12, ISSN 1654-1081.

* cited by examiner

*Primary Examiner* — Dennis R Cordray
*Assistant Examiner* — Matthew M Eslami
(74) *Attorney, Agent, or Firm* — Greer, Burns & Crain, Ltd.

(57) ABSTRACT

The present invention relates to a method for manufacturing a web or film comprising highly refined cellulose fibers in a paper machine, the method comprising the steps of: a) forming a wet web by applying an aqueous pulp suspension comprising highly refined cellulose fibers on a wire; and b) dewatering the wet web on the wire to obtain a dewatered web comprising highly refined cellulose fibers, wherein the dewatering comprises membrane assisted dewatering using a gas permeable membrane temporarily applied to the wet web, wherein the gas permeable membrane has a lower air permeability than the wire.

28 Claims, No Drawings

METHOD FOR MANUFACTURING FILMS COMPRISING HIGHLY REFINED CELLULOSE FIBERS

This application is a U.S. National Phase under 35 U.S.C. § 371 of International Application No. PCT/IB2021/053949 filed May 10, 2021, which claims priority under 35 U.S.C. §§ 119 and 365 to Swedish Application No. 2050548-3 filed May 11, 2020.

TECHNICAL FIELD

The present disclosure relates to gas barrier films, e.g. useful in paper and paperboard based packaging materials. More specifically, the present disclosure relates to methods for manufacturing films comprising highly refined cellulose fibers, particularly films comprising microfibrillated cellulose (MFC).

BACKGROUND

Effective gas, aroma, and/or moisture barriers are required in packaging industry for shielding sensitive products. Particularly, oxygen-sensitive products require an oxygen barrier to extend their shelf-life. Oxygen-sensitive products include many food products, but also pharmaceutical products and electronic industry products. Known packaging materials with oxygen barrier properties may be comprised of one or several polymer films or of a fibrous paper or board coated with one or several layers of an oxygen barrier polymer, usually as part of a multilayer coating structure. Another important property for packaging for food products is resistance to grease and oil.

More recently, microfibrillated cellulose (MFC) films have been developed, in which defibrillated cellulosic fibrils have been suspended e.g. in water, re-organized and rebonded together to form a continuous film. MFC films have been found to provide good gas barrier properties as well as good resistance to grease and oil.

MFC films may be made by use of casting technologies, including applying an MFC dispersion onto a non-porous cast substrate, such as a polymeric or metal substrate, and drying said film by evaporation. The advantages of this technology include uniform thickness distribution and a smooth surface of the film. The publication EP2771390 A4 describes preparation of MFC films, in which an aqueous cellulose nanofiber dispersion is coated on a paper or polymeric substrate, dried and finally peeled off as a nanofiber film sheet.

A problem connected with the casting process is that when the film is forming in the drying step, the slow diffusion of water restricts the drying rate. The diffusion of water vapor through the film is a slow process which has a negative impact on the process efficiency. If the drying speed is increased, pinholes may be formed in the film, deteriorating its barrier properties. A further problem with the cast process is the formation of shrink tensions in the formed film which may have a negative impact on its strength properties, such as strain at break or tensile strength.

Alternatively, the film can be made by applying an MFC suspension on a porous substrate forming a web followed by dewatering of the web by draining water through the substrate for forming the film. The porous substrate may for example be a membrane or wire fabric or it can be a paper or paperboard substrate. Formation of the web can be accomplished e.g. by use of a paper- or paperboard machine type of process. US patent application US20120298319 A1 teaches a method of manufacturing an MFC film by applying a furnish comprising MFC directly on porous substrate thus allowing the MFC to be dewatered and filtered.

Manufacturing of films and barrier substrates from highly refined cellulose or suspension with very slow drainage is difficult on a paper machine since it is difficult to create good barriers due to occurrence of pinholes. Pinholes are microscopic holes that can appear in the web during the forming process. Examples of reasons for the appearance of pinholes include irregularities in the pulp suspension, e.g. formed by flocculation or re-flocculation of fibrils, rough dewatering fabric, uneven pulp distribution on the wire, or too low a web grammage. Pinhole formation typically increases with increased dewatering speed. However, in pinhole free areas, the Oxygen Transmission Rate value is good when grammage is above 20-40 g/m$^2$.

One approach to improve barrier properties has been to make a thin base substrate, which comprises some pinholes, and then to coat the substrate with a polymeric coating composition. This approach, however, requires a coating concept and a coating formulation that is optimized in terms of surface filling and simultaneously providing barrier. Coating of a thin web is also challenging since the coating may cause web breaks. The number of times a substrate is rewetted and dried, should also be kept to a minimum since each additional step adds costs. Polymeric coatings may also reduce the repulpability of the film and thereby the recyclability of products comprising the film.

Another possibility discussed in the prior art would be to have extremely slow dewatering time, however this is not feasible for high speed and intensive drainage concepts.

Another solution would be to increase the grammage or coarseness of the film, but that will significantly increase dewatering time and increase risk for pinholes, respectively.

From a technical and economical point of view, it would be preferable to find a solution that enables fast dewatering, and at the same time improves either the film mechanical properties or barrier properties, or both.

DESCRIPTION OF THE INVENTION

It is an object of the present disclosure to provide a method for manufacturing a film comprising highly refined cellulose fibers, such as microfibrillated cellulose (MFC), which alleviates at least some of the above mentioned problems associated with prior art methods.

It is a further object of the present disclosure to provide a method for manufacturing a film comprising highly refined cellulose fibers with reduced pinhole formation.

It is a further object of the present disclosure to provide an improved method for manufacturing a film comprising highly refined cellulose fibers in a paper- or paperboard machine type of process.

It is a further object of the present disclosure to provide a film useful as gas barrier in a paper or paperboard based packaging material which is based on renewable raw materials.

It is a further object of the present disclosure to provide a film useful as gas barrier in a paper or paperboard based packaging material with high repulpability, providing for high recyclability of packaging products comprising the film.

The above-mentioned objects, as well as other objects as will be realized by the skilled person in the light of the present disclosure, are achieved by the various aspects of the present disclosure.

According to a first aspect illustrated herein, there is provided a method for manufacturing a web or film comprising highly refined cellulose fibers in a paper machine, the method comprising the steps of:

a) forming a wet web by applying an aqueous pulp suspension comprising highly refined cellulose fibers on a wire; and b) dewatering the wet web on the wire to obtain a dewatered web comprising highly refined cellulose fibers, wherein the dewatering comprises membrane assisted dewatering using a gas permeable membrane temporarily applied to the wet web, wherein the gas permeable membrane has a lower air permeability than the wire.

The present invention is based on the realization that many of the problems encountered when dewatering of pulps comprising highly refined cellulose fibers on the wire of a paper machine can be solved or ameliorated by the use of a technique referred to as membrane assisted dewatering. In the membrane assisted dewatering a gas permeable membrane, typically a thin woven or non-woven polymeric fabric or porous polymer film, is temporarily applied to the wet web during the dewatering step. The gas permeable membrane is then pressed against the wet web. The pressure can be applied by applying a negative gas pressure, i.e. vacuum, to the bottom surface of the wire, whereby the wet web and the gas permeable membrane are both sucked towards the wire. When using a negative pressure, the dewatering can be called membrane assisted vacuum dewatering. The pressure can also be applied by applying a positive gas pressure, e.g. in the form of air or steam, to the top surface of the gas permeable membrane, pressing the gas permeable membrane and the wet web towards the wire. The gas permeable membrane reduces the gas flow through the wet web. The positive or negative gas pressure applied should preferably be high enough to achieve efficient dewatering, but low enough such that the gas flow through the wet web is very low, since a high gas flow through the web may cause formation of new pin holes or enlarge existing pinholes. In some embodiments, the positive or negative gas pressure applied is selected such that the gas flow through the wet web is zero, or close to zero. A low gas flow through the wet web is also advantageous as it minimizes the energy required for the maintaining the positive or negative gas pressure.

The pressure of the gas permeable membrane has been found to effectively counteract the formation of pinholes in the wet web as the dewatering speed is increased. Applying a gas permeable membrane having a lower air permeability than the wire restricts the gas flow through the wet web and allows a strong vacuum to be maintained under the wire. Without wishing to be bound to any specific scientific theory, it is believed that the decreased pinhole formation may be due to a combination of the reduced gas flow, and the gas permeable membrane retaining the shape of the wet web and helping to distribute the gas flow through the web more evenly across the web surface.

The use of the gas permeable membrane allows faster dewatering of the wet web as significantly higher vacuum and/or gas flow through the web can be used without deteriorating the film properties. The membrane assisted dewatering has been found to substantially eliminate occurrence of pinholes in the finished film, while still allowing a high production speed. In the prior art, increased dewatering speed has sometimes been achieved by using large amounts of retention and drainage chemicals at the wet end of the process, causing increased flocculation. However, retention and drainage chemicals may also cause a more porous web structure, and thus there is a need to minimize the use of such chemicals. The inventive method provides an alternative way of increasing dewatering speed, which is less dependent on the addition of retention and drainage chemicals.

The term "film" as used herein refers generally to a thin continuous sheet formed material. Depending on the composition of the pulp suspension, the film can also be considered as a thin paper or even as a membrane. The inventive method allows for manufacturing a film comprising highly refined cellulose fibers in a paper machine type of process. More importantly, the method allows for the manufacture of films having a relatively high grammage in the range of 20-100 g/m$^2$ which films have a very low occurrence of pinholes or are substantially pinhole free. Because of the content of highly refined cellulose fibers, the resulting film will typically have a density above 600 kg/m$^3$, preferably above 900 kg/m$^3$. Such films have been found to be very useful as gas barrier films, e.g. in packaging applications. The films can be used to replace conventional barrier films, such as synthetic polymer films which reduce the recyclability of paper or paperboard packaging products. The inventive films have high repulpability, providing for high recyclability of the films and paper or paperboard packaging products comprising the films.

Although different arrangements for performing the steps of the inventive method could be contemplated by the skilled person, the inventive method may advantageously be performed in a paper machine, more preferably in a Fourdrinier paper machine.

A paper machine (or paper-making machine) is an industrial machine which is used in the pulp and paper industry to create paper in large quantities at high speed. Modern paper-making machines are typically based on the principles of the Fourdrinier Machine, which uses an endless belt of woven mesh, a "wire", to create a continuous web by filtering out the fibers held in a pulp suspension and producing a continuously moving wet web of fiber. The terms "wet web" or "web" are used herein to denote the intermediate product formed when the aqueous pulp suspension is formed on the wire. The wet web is then dewatered and dried in the machine to obtain a paper or film comprising the fibers.

The forming and dewatering steps of the inventive method are preferably performed at the forming section of the paper machine, commonly called the wet end. The wet web is formed on a wire in the forming section of the paper machine. The wire used in the inventive method preferably has relatively high porosity in order to allow fast dewatering and high drainage capacity. The air permeability of the wire is typically above 5000 m$^3$/m$^2$/hour at 100 Pa. The wire may preferably comprise at least 500 knuckles per cm$^2$, and more preferably at least 1000 knuckles per cm$^2$ to reduce fiber marking.

The membrane assisted dewatering preferably comprises temporarily applying a gas permeable membrane to the wet web and pressing the wet web between the wire and the gas permeable membrane. The membrane having a lower air permeability than the wire restricts the gas flow through the wet web and allows a strong vacuum to be maintained under the wire. In some embodiments, the gas flow through the wet web under the gas permeable membrane is at least 50% lower, preferably at least 75% lower, than the gas flow through the wet web under the same conditions without the gas permeable membrane. In some embodiments, the gas flow through the wet web when the membrane is applied is zero, or close to zero.

The gas permeable membrane is preferably selected from the group consisting of a woven polymeric fabric, a non-woven polymeric fabric, and a porous polymer film. The woven polymeric fabric may for example be a very fine paper wire having an air permeability which is significantly lower than the air permeability of the wire used for forming the wet web. The non-woven polymeric fabric may for example be a compressed polyethylene fiber non-woven such as Tyvek®. The porous polymer film may for example be a monolithic ePTFE polymer film or the like.

The thickness of the gas permeable membrane is preferably in the range of 0.01-4 mm, more preferably in the range of 0.01-2 mm. In order to improve the strength of the membrane it may be laminated to a carrier material on the surface that will not be in contact with the wet web. The gas permeable membrane is preferably non-water absorbent, but the membrane may in some embodiments be combined with or laminated to a water absorbent material on the surface that will not be in contact with the wet web such that water passing through the membrane can be absorbed and removed.

Applying the gas permeable membrane on the wet web helps to retain the shape of the wet web and to distribute the gas flow through the web more evenly across the web surface.

The gas permeable membrane preferably has a permeability which allows gases, especially air and steam, to pass through the membrane, while it blocks passage of highly refined cellulose fibers and other solids present in the wet web. The permeable membrane may be permeable or non-permeable to water in liquid form. In most instances, and particularly where the membrane is non-permeable to water in liquid form, most or all of the water removed from the web will leave the web on the wire side. In embodiments wherein the membrane is permeable to water in liquid form, some removal of water from the web may also be possible on the membrane side.

In some embodiments, the gas permeable membrane is permeable to air and steam, but non-permeable or substantially non-permeable to the liquid water and highly refined cellulose fibers of the wet web. The air permeability of the membrane allows for air to pass through the membrane during dewatering of the web.

In some embodiments, the gas permeable membrane is permeable to air, steam and liquid water, but non-permeable or substantially non-permeable to the highly refined cellulose fibers of the wet web.

The air permeability of the gas permeable membrane is preferably significantly lower than the air permeability of the wire. The lower air permeability of the gas permeable membrane than the wire will cause the gas permeable membrane to be pressed against the wet web when a negative gas pressure (vacuum) is applied to the to the bottom surface of the wire or when a positive gas pressure is applied to the top surface of the gas permeable membrane. The pressure exerted by the gas permeable membrane on the wet web helps to further retain the shape of the wet web and to distribute the gas flow through the web more evenly across the web surface.

In some embodiments, the air permeability of the gas permeable membrane is less than 75% of the air permeability of the wire. In preferred embodiments, the air permeability of the gas permeable membrane is less than 50% of the air permeability of the wire.

The wire used in the inventive method preferably has relatively high air permeability in order to allow fast dewatering and high drainage capacity. The wire preferably has an air permeability above 5000 $m^3/m^2$/hour at 100 Pa.

The gas permeable membrane preferably has an air permeability well below 5000 $m^3/m^2$/hour at 100 Pa. In some embodiments, the gas permeable membrane has an air permeability below 3500 $m^3/m^2$/hour at 100 Pa, and preferably below 3000 $m^3/m^2$/hour at 100 Pa.

The application of the gas permeable membrane is combined with the application of a negative gas pressure (vacuum) applied to the wire. The negative gas pressure is applied to the surface of the wire opposite to the surface on which the wet web and membrane is positioned. Thus, in a conventional horizontal wire arrangement, the negative gas pressure is applied to the bottom surface of the wire, while the wet web and membrane are positioned on the top surface of the wire. The vacuum in this membrane assisted dewatering can be provided by any of a range of methods for vacuum assisted dewatering known in the art. In some embodiments a positive gas pressure is also applied to the gas permeable membrane, i.e. both a negative (vacuum) and a positive pressure can be applied.

Thus, in some embodiments, the wet web is pressed between the gas permeable membrane and the wire. The pressure causes water present in the wet web to be displaced towards, and removed through, the wire. The displacement of water is due to a combination of the vacuum on the wire side, some gas passing through the membrane, the web and finally the wire, and compression of the web caused by the difference in air permeability between the gas permeable membrane and the wire. The air permeability of the gas permeable membrane allows some air to pass through the membrane and prevents the web from being crushed.

In some embodiments, the wet web is pressed between the wire and the gas permeable membrane by applying a negative gas pressure to the wire. The negative gas pressure may for example be applied using one or more suction boxes or suction rolls, foils or table rolls.

The negative gas pressure (i.e. suction pressure) applied to the wire in conventional vacuum dewatering (without a membrane), is typically in the range of 5-40 kPa, and more preferably in the range of 5-25 kPa. The negative gas pressure (i.e. suction pressure) applied to the wire in the inventive membrane assisted dewatering may typically be in the range of 15-90 kPa. In some embodiments, the negative gas pressure applied to the wire is in the range of 30-90 kPa or in the range of 45-90 kPa.

The negative gas pressure applied to the wire in the inventive membrane assisted dewatering is preferably high enough to achieve efficient dewatering, but low enough such that the gas flow through the wet web is very low, since a high gas flow through the web may cause formation of new pin holes or enlarge existing pinholes. In some embodiments, the negative gas pressure applied to the wire in the inventive membrane assisted dewatering is selected such that the gas flow through the wet web is zero, or close to zero. A low gas flow through the wet web is also advantageous as it minimizes the energy required for the maintaining the negative gas pressure.

Vacuum dewatering is typically very energy intensive and may account for a large portion of the total electric energy consumption of a paper machine. As the membrane reduced the gas flow through the web, the membrane assisted dewatering allows for a strong vacuum to be maintained under the wire with a lower energy consumption.

In some embodiments, the negative gas pressure applied to the wire under the membrane is applied in two different negative gas pressure zones arranged in sequence and wherein the negative gas pressure in each zone can be controlled independently. For example, a first pressure zone may have a lower negative gas pressure (weaker vacuum) and a subsequent second pressure zone may have a higher negative gas pressure (stronger vacuum), such that the vacuum is increased as the water content of the web is decreased.

The temperature of the wet web during the membrane assisted dewatering is preferably kept above 40° C., preferably above 45° C., and more preferably above 50° C. The membrane assisted dewatering will typically cause the temperature of the wet web to decrease. Thus, in some embodiments, the web is heated before, during and/or after the membrane assisted dewatering. Heating of the web may be effected in various manners known in the art, e.g. using steam via a steam box or similar.

In some embodiments, the wet web is further pressed between the gas permeable membrane and the wire by applying a positive gas pressure to the gas permeable membrane. Positive gas pressure applied to the gas permeable membrane can be used as an alternative or as a complement to negative gas pressure applied to the wire under the membrane. The positive gas pressure may for example be applied in the form of pressurized air or steam using one or more pressure boxes or steam boxes. Applying pressure in the form of pressurized steam has the added benefit of heating the web to counteract the temperature decrease caused by the vacuum dewatering.

The positive gas pressure applied to the wire in the inventive membrane assisted dewatering is preferably selected such that the gas flow through the wet web is very low, since a high gas flow through the web may cause formation of new pin holes or enlarge existing pinholes.

In some embodiments, the positive gas pressure applied to the wire under the membrane is applied in two different positive gas pressure zones arranged in sequence and wherein the positive gas pressure in each zone can be controlled independently. For example, a first pressure zone may have a lower positive gas pressure and a subsequent second pressure zone may have a higher positive gas pressure, such that the positive gas pressure is increased as the water content of the web is decreased.

The pressure (negative or positive) may also be pulsed.

Although different arrangements for performing the steps of the inventive method could be contemplated by the skilled person, the inventive method may advantageously be performed in a paper machine, more preferably in a Fourdrinier paper machine. Accordingly, the inventive method is typically a continuous method.

The wire and the gas permeable membrane are preferably provided in the form of endless belts. Arrangements for dewatering a wet web between two permeable belts, e.g. between two mesh wires, are known to those skilled in the art of paper making.

The wet web is preferably pressed between the wire and the gas permeable membrane in one or more contact zones. The wire and the gas permeable membrane move in the same direction and at the same, or substantially the same, speed in the contact zone. The size and configuration of the contact zone may depend on the size of the wire and the desired degree of dewatering. The width of the contact zone preferably corresponds to the width of the wet web. The length of the contact zone in the machine direction, i.e. in the direction of travel of the wet web, depends on the desired degree of dewatering. The length of the contact zone determines the number and size of positive and negative gas pressure zones that can be arranged in the contact zone. In some embodiments, the length of the contact zone in the machine direction is in the range of 0.3-10 m, preferably in the range of 1-5 m. The total length of the membrane belt is of course much longer than the contact zone to allow for washing or cleaning of the membrane between each contact with the wet web. The total length of the membrane belt may for example be at least 3-5 times longer than the contact zone, and typically even longer.

The speed of the wire and the gas permeable membrane the machine direction in the contact zone is preferably above 250 m/min, preferably above 350 m/min, and more preferably above 500 m/min.

If the water content of the wet web is too high when it enters the membrane assisted dewatering there is a risk for crushing of the web. Accordingly, in some cases it may be preferred to first subject the wet web to a partial dewatering without the use of a gas permeable membrane before the membrane assisted dewatering. Partial dewatering of the web on the wire may be performed using methods and equipment known in the art. Examples include but are not limited to gravitational dewatering, suction boxes, suction rolls, table roll and foils, frictionless dewatering and ultrasound assisted vacuum dewatering. Partial dewatering means that the dry solids content of the wet web is reduced compared to the dry solids content of the pulp suspension, but that the dewatered web still comprises a significant amount of water.

The purpose of the partial dewatering is to increase the dry solids content of the wet web to a level suitable for membrane assisted dewatering. Thus, in some embodiments, the dewatering step b) comprises partially dewatering the wet web before the membrane assisted dewatering.

The dry solids content of the pulp suspension is typically in the range of 0.1-0.7 wt %. In some embodiments, partial dewatering of the wet web means that the dry solids content of the partially dewatered web is above 0.5 wt % but below 15 wt %. In some embodiments, partial dewatering of the wet web means that the dry solids content of the partially dewatered web is above 0.5 wt % but below 10 wt %.

In some embodiments, the dry solids content of the wet web before the membrane assisted dewatering is above 0.5 wt %, preferably above 2 wt %, and more preferably above 4 wt %. In some embodiments, the dry solids content of the wet web before the membrane assisted dewatering is in the range of 0.5-10 wt %, preferably in the range of 2-10 wt %, and more preferably in the range of 4-10 wt %.

When the pulp suspension is dewatered on the wire a visible boundary line will appear at a point where the web goes from having a reflective water layer to where this reflective layer disappears. This boundary line between the reflective and non-reflective web is referred to as the waterline. The waterline is indicative of a certain solids content of the web. In some embodiments, the membrane assisted dewatering is arranged after the waterline.

In some embodiments, the dry solids content of the wet web after the membrane assisted dewatering is above 12 wt %, preferably above 14 wt %, and more preferably above 16 wt %. In some embodiments, the dry solids content of the wet web after the membrane assisted dewatering is in the range of 12-20 wt %, preferably in the range of 14-20 wt %, and more preferably in the range of 16-20 wt %.

The dewatering step b) may further comprises further dewatering the wet web after the membrane assisted dewatering. The further dewatering typically comprises pressing the web to squeeze out as much water as possible. The further dewatering may for example include passing the formed web through a press section of a paper machine, where the web passes between large rolls loaded under high pressure to squeeze out as much water as possible. The removed water is typically received by a fabric or felt. The dry solids content of the film after the further dewatering should be as high as possible. In some embodiments, the dry solids content of the film after the further dewatering is in the range of 20-70 wt %, preferably in the range of 30-60 wt %.

In some embodiments, the method further comprises:

c) drying the dewatered web to obtain a film comprising the highly refined cellulose fibers.

The drying may for example include drying the web by passing the web around a series of heated drying cylinders. Drying may typically reduce the water content down to a level of about 1-15 wt %, preferably to about 2-10 wt %.

The dry solids content of the final film may vary depending on the intended use of the film. For example a film for use as a stand-alone product may have a dry solids content in the range of 85-99 wt %, preferably in the range of 90-98 wt %, whereas a film for use in further lamination to form paper or paperboard based packaging material may have a dry solids content in the range of less than 90 wt %, preferably less than 85 wt %, such as in the range of 30-85 wt %.

The pulp suspension is an aqueous suspension comprising a water-suspended mixture of cellulose based fibrous material and optionally non-fibrous additives. The inventive method uses a pulp suspension comprising highly refined cellulose fibers. Refining, or beating, of cellulose pulps refers to mechanical treatment and modification of the cellulose fibers in order to provide them with desired properties. The highly refined cellulose fibers can be produced from different raw materials, for example softwood pulp or hardwood pulp. The highly refined cellulose fibers are preferably never dried cellulose fibers.

In some embodiments, the pulp suspension comprises at least 50 wt % highly refined cellulose fibers, based on the total dry weight of the pulp suspension.

The term highly refined cellulose fibers as used herein preferably refers to refined cellulose fibers having a Schopper-Riegler (SR) value of 65 or higher, preferably 70 or higher, as determined by standard ISO 5267-1.

In some embodiments, the pulp suspension is formed from a cellulose furnish having a Schopper-Riegler (SR) value in the range of 70-99.

The dry solids content of the pulp suspension is typically in the range of 0.1-0.7 wt %, preferably in the range of 0.15-0.5 wt %, more preferably in the range of 0.2-0.4 wt %.

The dry solids content of the pulp suspension may be comprised solely of the highly refined cellulose fibers, or it can comprise a mixture of highly refined cellulose fibers and other ingredients or additives. The pulp suspension preferably includes highly refined cellulose fibers as its main component based on the total dry weight of the pulp suspension. In some embodiments, the pulp suspension comprises at least 50 wt %, preferably at least 70 wt %, more preferably at least 80 wt % or at least 90 wt % of highly refined cellulose fibers, based on the total dry weight of the pulp suspension.

In some embodiments, the highly refined cellulose fibers of the pulp suspension is refined Kraft pulp. Refined Kraft pulp will typically comprise at least 10% hemicellulose. Thus, in some embodiments the pulp suspension comprises hemicellulose at an amount of at least 10%, such as in the range of 10-25%, of the amount of the highly refined cellulose fibers.

The pulp suspension may further comprise additives such as native starch or starch derivatives, cellulose derivatives such as sodium carboxymethyl cellulose, a filler, retention and/or drainage chemicals, flocculation additives, deflocculating additives, dry strength additives, softeners, cross-linking aids, sizing chemicals, dyes and colorants, wet strength resins, fixatives, de-foaming aids, microbe and slime control aids, or mixtures thereof. The pulp suspension may further comprise additives that will improve different properties of the mixture and/or the produced film such as latex and/or polyvinyl alcohol (PVOH) for enhancing the ductility of the film. The inventive method provides an alternative way of increasing dewatering speed, which is less dependent on the addition of retention and drainage chemicals, but smaller amounts of retention and drainage chemicals may still be used.

The inventive method is especially useful for manufacturing films of so called microfibrillated cellulose (MFC). Thus, in some embodiments the highly refined cellulose fibers is MFC.

Microfibrillated cellulose (MFC) shall in the context of the patent application be understood to mean a nano scale cellulose particle fiber or fibril with at least one dimension less than 100 nm. MFC comprises partly or totally fibrillated cellulose or lignocellulose fibers. The liberated fibrils have a diameter less than 100 nm, whereas the actual fibril diameter or particle size distribution and/or aspect ratio (length/width) depends on the source and the manufacturing methods. The smallest fibril is called elementary fibril and has a diameter of approximately 2-4 nm (see e.g. Chinga-Carrasco, G., *Cellulose fibres, nanofibrils and microfibrils: The morphological sequence of MFC components from a plant physiology and fibre technology point of view, Nanoscale research letters* 2011, 6:417), while it is common that the aggregated form of the elementary fibrils, also defined as microfibril (Fengel, D., *Ultrastructural behavior of cell wall polysaccharides, Tappi J.*, March 1970, Vol 53, No. 3), is the main product that is obtained when making MFC e.g. by using an extended refining process or pressure-drop disintegration process. Depending on the source and the manufacturing process, the length of the fibrils can vary from around 1 to more than 10 micrometers. A coarse MFC grade might contain a substantial fraction of fibrillated fibers, i.e. protruding fibrils from the tracheid (cellulose fiber), and with a certain amount of fibrils liberated from the tracheid (cellulose fiber).

There are different acronyms for MFC such as cellulose microfibrils, fibrillated cellulose, nanofibrillated cellulose, fibril aggregates, nanoscale cellulose fibrils, cellulose nanofibers, cellulose nanofibrils, cellulose microfibers, cellulose fibrils, microfibrillar cellulose, microfibril aggregates and cellulose microfibril aggregates. MFC can also be characterized by various physical or physical-chemical properties such as its large surface area or its ability to form a gel-like material at low solids (1-5 wt %) when dispersed in water.

Various methods exist to make MFC, such as single or multiple pass refining, pre-hydrolysis followed by refining or high shear disintegration or liberation of fibrils. One or several pre-treatment steps are usually required in order to make MFC manufacturing both energy efficient and sustainable. The cellulose fibers of the pulp to be utilized may thus be pre-treated, for example enzymatically or chemically, to hydrolyse or swell the fibers or to reduce the quantity of hemicellulose or lignin. The cellulose fibers may be chemically modified before fibrillation, such that the cellulose molecules contain other (or more) functional groups than found in the native cellulose. Such groups include, among others, carboxymethyl (CMC), aldehyde and/or carboxyl groups (cellulose obtained by N-oxyl mediated oxidation, for example "TEMPO"), quaternary ammonium (cationic cellulose) or phosphoryl groups. After being modified or oxidized in one of the above-described methods, it is easier to disintegrate the fibers into MFC or nanofibrils.

The nanofibrillar cellulose may contain some hemicelluloses, the amount of which is dependent on the plant source. Mechanical disintegration of the pre-treated fibers, e.g. hydrolysed, pre-swelled, or oxidized cellulose raw material is carried out with suitable equipment such as a refiner, grinder, homogenizer, colloider, friction grinder, ultrasound sonicator, fluidizer such as microfluidizer, macrofluidizer or fluidizer-type homogenizer. Depending on the MFC manufacturing method, the product might also contain fines, or nanocrystalline cellulose, or other chemicals present in wood fibers or in papermaking process. The product might also contain various amounts of micron size fiber particles that have not been efficiently fibrillated.

MFC is produced from wood cellulose fibers, both from hardwood and softwood fibers. It can also be made from microbial sources, agricultural fibers such as wheat straw pulp, bamboo, bagasse, or other non-wood fiber sources. It is preferably made from pulp including pulp from virgin fiber, e.g. mechanical, chemical and/or thermomechanical pulps. It can also be made from broke or recycled paper.

The dry solids content of the pulp suspension may be comprised solely of MFC, or it can comprise a mixture of MFC and other ingredients or additives. The pulp suspension preferably includes MFC as its main component based on the total dry weight of the pulp suspension. In some embodiments, the pulp suspension comprises 50-99 wt %, preferably at least 70-99 wt %, more preferably at least 80-99 wt % MFC, based on the total dry weight of the pulp suspension.

In some embodiments, at least some of the MFC is obtained from MFC broke.

In addition to the highly refined cellulose fibers, the pulp suspension may also comprise a certain amount of unrefined or slightly refined cellulose fibers. The term unrefined or slightly refined fibers as used herein preferably refers to cellulose fibers having a Schopper-Riegler (SR) value below 30, preferably below 28, as determined by standard ISO 5267-1. Unrefined or slightly refined cellulose fibers are useful to enhance dewatering and may also improve strength and fracture toughness of the film. In some embodiments, the pulp suspension comprises 0.1-50 wt %, preferably 0.1-30 wt %, and more preferably 0.1-10 wt % of unrefined or slightly refined cellulose fibers, based on the total dry weight of the pulp suspension. The unrefined or slightly refined cellulose fibers may for example be obtained from bleached or unbleached or mechanical or chemimechanical pulp or other high yield pulps. The unrefined or slightly refined cellulose fibers are preferably never dried cellulose fibers.

The pH value of the pulp suspension may typically be in the range of 4-10 preferably in the range of 5-8, and more preferably in the range of 5.5-7.5.

The temperature of the pulp suspension may typically be in the range of 30-70° C., preferably in the range of 40-60° C., and more preferably in the range of 45-55° C.

The basis weight of the wet web, and the finished web or film, based on the total dry weight of the web is typically less than 100 g/m$^2$, preferably less than 60 g/m$^2$, and more preferably less than 40 g/m$^2$. In some embodiments, the basis weight of the wet web based on the total dry weight of the web is in the range of 10-100 g/m$^2$, preferably in the range of 10-60 g/m$^2$, more preferably in the range of 10-40 g/m$^2$. Pinhole free films with basis weights in these ranges have been found have good oxygen barrier properties.

Films comprising high amounts of highly refined cellulose fibers are typically transparent or translucent to visible light. Thus, in some embodiments the film is transparent or translucent to visible light.

The film will typically exhibit good resistance to grease and oil. Grease resistance of the film was evaluated by the KIT-test according to standard ISO 16532-2. The test uses a series of mixtures of castor oil, toluene and heptane. As the ratio of oil to solvent is decreased, the viscosity and surface tension also decrease, making successive mixtures more difficult to withstand. The performance is rated by the highest numbered solution which does not darken the sheet after 15 seconds. The highest numbered solution (the most aggressive) that remains on the surface of the paper without causing failure is reported as the "kit rating" (maximum 12). In some embodiments, the KIT value of the film is at least 10, as measured according to standard ISO 16532-2.

Pinholes are microscopic holes that can appear in the web during the forming process. Examples of reasons for the appearance of pinholes include irregularities in the pulp suspension, e.g. formed by flocculation or re-flocculation of fibrils, rough dewatering fabric, uneven pulp distribution on the wire, or too low a web grammage. In some embodiments, the film comprises less than 10 pinholes/m$^2$, preferably less than 8 pinholes/m$^2$, and more preferably less than 2 pinholes/m$^2$, as measured according to standard EN13676: 2001. The measurement involves treating the film with a coloring solution (e.g. dyestuff E131 Blue in ethanol) and inspecting the surface microscopically.

In some embodiments, the film has a Gurley Hill value of at least 30 000 s/100 ml, as measured according to standard ISO 5636/6.

The film preferably has high repulpability. In some embodiments, the film exhibits less than 30%, preferably less than 20%, and more preferably less than 10% residues, when tested as a category II material according to the PTS-RH 021/97 test method.

In some embodiments, the film has an oxygen transfer rate (OTR) of less than 150 cc/m$^2$/24 h/atm, as measured according to the standard ASTM D-3985 at 50% relative humidity and 23° C.

According to a second aspect illustrated herein, there is provided a web or film comprising highly refined cellulose, wherein the web or film is obtainable by the inventive method.

The term film as used herein refers generally to a thin continuous sheet formed material. Depending on the composition of the pulp suspension, the film can also be considered as a thin paper or even as a membrane. The film preferably has a grammage below 100 g/m$^2$, preferably in the range of 20-100 g/m$^2$. The film is typically relatively dense. In some embodiments, the film has a density above 600 kg/m$^3$, preferably above 900 kg/m$^3$.

The inventive films are especially suited as thin packaging films when coated or laminated with one or more layers of a thermoplastic polymer. Thus, the film may preferably be coated or laminated with one or more polymer layers.

The film may be provided with a polymer layer on one side or on both sides.

The polymer layer may comprise any of the thermoplastic polymers commonly used in paper or paperboard based packaging materials in general or polymers used in liquid packaging board in particular. Examples include polyethylene (PE), polyethylene terephthalate (PET), polypropylene (PP), polylactic acid (PLA), polyglycolic acid (PGA), starch and cellulose. Polyethylenes, especially low density polyethylene (LDPE) and high density polyethylene (HDPE), are the most common and versatile polymers used in liquid packaging board.

Thermoplastic polymers, are useful since they can be conveniently processed by extrusion coating techniques to form very thin and homogenous films with good liquid barrier properties. In some embodiments, the polymer layer comprises polypropylene or polyethylene. In preferred embodiments, the polymer layer comprises polyethylene, more preferably LDPE or HDPE.

The polymer layer may comprise one or more layers formed of the same polymeric resin or of different polymeric resins. In some embodiments the polymer layer comprises a mixture of two or more different polymeric resins. In some embodiments the polymer layer is a multilayer structure comprised of two or more layers, wherein a first layer is comprised of a first polymeric resin and a second layer is comprised of a second polymeric resin, which is different from the first polymeric resin.

In some embodiments, the polymer layer is formed by extrusion coating of the polymer onto a surface of the film. Extrusion coating is a process by which a molten plastic material is applied to a substrate to form a very thin, smooth and uniform layer. The coating can be formed by the extruded plastic itself, or the molten plastic can be used as an adhesive to laminate a solid plastic film onto the substrate. Common plastic resins used in extrusion coating include polyethylene (PE), polypropylene (PP), and polyethylene terephthalate (PET).

The basis weight of each polymer layer of the film is preferably less than 50 g/m$^2$. In order to achieve a continuous and substantially defect free film, a basis weight of the polymer layer of at least 8 g/m$^2$, preferably at least 12 g/m$^2$ is typically required. In some embodiments, the basis weight of the polymer layer is in the range of 8-50 g/m$^2$, preferably in the range of 12-50 g/m$^2$.

The inventive film may preferably be used as a gas barrier layer in a paper or paperboard based packaging material, e.g. in liquid packaging board (LPB) for use in the packaging of liquids or liquid containing products.

Therefore, according to a third aspect illustrated herein, there is provided a paper or paperboard based packaging material comprising:

a paper or paperboard substrate; and a film obtainable by the inventive method.

Paper generally refers to a material manufactured in sheets or rolls from the pulp of wood or other fibrous substances comprising cellulose fibers, used for e.g. writing, drawing, or printing on, or as packaging material. Paper can either be bleached or unbleached, coated or uncoated, and produced in a variety of thicknesses, depending on the end-use requirements.

Paperboard generally refers to strong, thick paper or cardboard comprising cellulose fibers used for example as flat substrates, trays, boxes and/or other types of packaging. Paperboard can either be bleached or unbleached, coated or uncoated, and produced in a variety of thicknesses, depending on the end-use requirements.

The film of the paper or paperboard based packaging material according to the second aspect may be further defined as set out above with reference to the first aspect.

In some embodiments, the film is attached to the paper or paperboard substrate directly, e.g. when the film is wet laid onto the substrate. Thus, in some embodiments the film is in direct contact with the substrate.

In other embodiments, the film is attached to the paper or paperboard substrate indirectly, e.g. when the film is laminated onto the substrate using an adhesive layer disposed between the substrate and the film. Thus, in some embodiments the paper or paperboard based packaging material further comprises an adhesive layer disposed between the substrate and the film.

In some embodiments, the paper or paperboard based packaging material has a water vapor transfer rate (WVTR), measured according to the standard ISO 15106-2/ASTM F1249 at 50% relative humidity and 23° C., of less than 200 g/m$^2$/24 h.

In some embodiments, the paper or paperboard based packaging material has an oxygen transfer rate (OTR), measured according to the standard ASTM D-3985 at 50% relative humidity and 23° C., of less than 150 cc/m$^2$/24 h/atm, preferably less than 100 cc/m$^2$/24 h/atm, and more preferably less than 50 cc/m$^2$/24 h/atm.

Generally, while the products, polymers, materials, layers and processes are described in terms of "comprising" various components or steps, the products, polymers, materials, layers and processes can also "consist essentially of" or "consist of" the various components and steps.

Example

An experiment was performed in a pilot machine to show that the membrane assisted dewatering will lead to a product with good barrier properties, i.e. with reduced number of pinholes.

A furnish comprising 100 wt % of microfibrillated cellulose, based on total amount of fibers, was conducted through a headbox onto a wire. A membrane was thereafter applied on top of the formed web on the wire. Vacuum boxes were places under the wire to dewater the web via negative pressure. The formed film had a grammage of 30 gsm and the MFC had a SR value of 94.

TABLE 1

| OTR values of measured film, measured according to ASTM D-3985. | | |
|---|---|---|
| | OTR value 23° C./50% RH cc/m$^2$/24 h | |
| MFC film | 9.2 | 8.5 |

The result show that a film with good OTR values, i.e. values below 10, was produced with the dewatering method according to the invention.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method for manufacturing a film comprising highly refined cellulose fibers in a paper machine, the method comprising the steps of the following sequence:

a) forming a wet web by applying an aqueous pulp suspension comprising highly refined cellulose fibers having a Schopper-Riegler (SR) value of 65 or higher, on a wire;

b) dewatering the wet web on the wire to obtain a dewatered web comprising highly refined cellulose fibers, wherein the dewatering comprises membrane assisted dewatering using a gas permeable membrane temporarily applied to the wet web, wherein the gas permeable membrane has an air permeability lower than an air permeability of the wire, wherein the air permeability of the gas permeable membrane is less than 75% of the air permeability of the wire, and wherein the wet web is pressed between the gas permeable membrane and the wire; and, c) drying the dewatered web to obtain a film comprising the highly refined cellulose fibers, the film having a grammage in a range of 20 to 100 g/m$^2$ and a density above 600 kg/m$^3$, wherein the film is transparent or translucent to visible light, and wherein the film has a KIT value of at least 10, as measured according to standard ISO 16532-2.

2. The method according to claim 1, wherein the gas permeable membrane is selected from a group consisting of: a woven polymeric fabric, a non-woven polymeric fabric, and a porous polymer film.

3. The method according to claim 1, wherein a thickness of the gas permeable membrane is in a range of 0.01-4 mm.

4. The method according to claim 1, wherein the gas permeable membrane is permeable to air and steam, but substantially non-permeable to the liquid water and highly refined cellulose fibers of the wet web.

5. The method according to claim 1, wherein the gas permeable membrane is permeable to air, steam, and liquid water, but substantially non-permeable to the highly refined cellulose fibers of the wet web.

6. The method according to claim 1, wherein the air permeability of the gas permeable membrane is less than 50% of the air permeability of the wire.

7. The method according to claim 1, wherein the air permeability of the gas permeable membrane is below 3500 m$^3$/m$^2$/hour at 100 Pa.

8. The method according to claim 1, wherein the air permeability of the wire is above 5000 m$^3$/m$^2$/hour at 100 Pa.

9. The method according to claim 1, wherein the wet web is pressed between the wire and the gas permeable membrane by applying a negative gas pressure to the wire.

10. The method according to claim 1, wherein the wet web is pressed between the wire and the gas permeable membrane by applying a positive gas pressure to the gas permeable membrane.

11. The method according to claim 1, wherein the method is continuous.

12. The method according to any claim 1, wherein the wire and the gas permeable membrane are provided in the form of endless belts.

13. The method according to claim 1, wherein the wet web is pressed between the gas permeable membrane and the wire in a contact zone.

14. The method according to claim 13, further comprising:

moving both the wire and the gas permeable membrane, wherein the wire and the gas permeable membrane move in the same direction and at the same, or substantially the same, speed in the contact zone.

15. The method according to claim 13, wherein a length of the contact zone in the machine direction is in a range of 0.3-10 m.

16. The method according to claim 13, wherein the speed of the wire and the gas permeable membrane is above 250 m/min.

17. The method according to claim 1, wherein the dewatering step b) comprises partially dewatering the wet web without the use of a gas permeable membrane before the membrane assisted dewatering.

18. The method according to claim 1, wherein the dewatering step b) comprises further dewatering the wet web after the membrane assisted dewatering.

19. The method according to claim 1, wherein the pulp suspension comprises at least 50 wt % highly refined cellulose fibers, based on a total dry weight of the pulp suspension.

20. The method according to claim 1, wherein the pulp suspension is formed from a cellulose furnish having a Schopper-Riegler (SR) value in a range of 70-99.

21. The method according to claim 1, wherein the highly refined cellulose fibers comprises microfibrillated cellulose (MFC).

22. The method according to claim 1, wherein a basis weight of the wet web based on a total dry weight of the web is in a range of 10-100 g/m$^2$.

23. The method according to claim 1, wherein a dry solids content of the wet web before the membrane assisted dewatering is above 0.5 wt %.

24. The method according to claim 1, wherein a dry solids content of the wet web after the membrane assisted dewatering is above 12 wt %.

25. The method according to claim 1, wherein the density of the film is above 900 kg/m$^3$.

26. The method according to claim 25, wherein the film comprises less than 10 pinholes/m$^2$, as measured according to standard EN13676:2001.

27. The method according to claim 25, wherein the film has a Gurley Hill value of at least 30,000 s/100 ml, as measured according to standard ISO 5636/6.

28. The method according to claim 25, wherein the film has an oxygen transfer rate (OTR) of less than 150 cc/m$^2$/24 h/atm, as measured according to the standard ASTM D-3985 at 50% relative humidity and 23° C.

* * * * *